US009949038B2

(12) United States Patent
Guindi et al.

(10) Patent No.: US 9,949,038 B2
(45) Date of Patent: Apr. 17, 2018

(54) HEARING ASSISTANCE SYSTEM AND METHOD

(71) Applicant: SONOVA AG, Stäfa (CH)

(72) Inventors: Nadim El Guindi, Zürich (CH); Ivo Hasler, Winterthur (CH)

( * ) Notice: Subject to any disclaimer, the term of this patent is extended or adjusted under 35 U.S.C. 154(b) by 0 days.

(21) Appl. No.: 14/905,495

(22) PCT Filed: Aug. 9, 2013

(86) PCT No.: PCT/EP2013/066743
§ 371 (c)(1),
(2) Date: Jan. 15, 2016

(87) PCT Pub. No.: WO2015/018456
PCT Pub. Date: Feb. 12, 2015

(65) Prior Publication Data
US 2016/0157026 A1 Jun. 2, 2016

(51) Int. Cl.
*H04R 25/00* (2006.01)

(52) U.S. Cl.
CPC ..... *H04R 25/305* (2013.01); *H04R 25/552* (2013.01); *H04R 2225/33* (2013.01); *H04R 2225/55* (2013.01); *H04R 2225/61* (2013.01)

(58) Field of Classification Search
None
See application file for complete search history.

(56) References Cited

U.S. PATENT DOCUMENTS 6,901,275 B1 * 5/2005 Aoyagi ..... H04W 52/0261 370/311
8,041,066 B2 10/2011 Solum
8,050,439 B2 11/2011 Inoshita et al.
8,300,864 B2 10/2012 Müllenborn et al.
8,526,648 B2 9/2013 Dijkstra et al.
(Continued)

FOREIGN PATENT DOCUMENTS

EP 2 439 960 A1 4/2012

OTHER PUBLICATIONS

Collinson, Andy. "Estimating Transmitter Distance." Estimating Transmitter Distance. N.p., Jun. 14, 2003. Web. Nov. 29, 2016.*
(Continued)

*Primary Examiner* — Curtis Kuntz
*Assistant Examiner* — Kenny Truong

(57) ABSTRACT

A hearing assistance system having a first and second hearing assistance devices for hearing stimulation of first and second ears, each hearing assistance device having a first interface for wireless data exchange between the first hearing assistance device and the second hearing assistance device and a second interface for wireless reception of an external data stream from an external data stream source, each hearing assistance device being adapted to repeatedly exchange information concerning the charging status of the battery of the respective hearing assistance device with the other hearing assistance device in order to monitor the remaining battery lifetimes, wherein the hearing assistance devices are caused to switch the role of master and slave when the difference in the battery charges of the two devices exceeds a given threshold, with the hearing assistance device having the higher battery charge forming the new master after the role switching.

29 Claims, 2 Drawing Sheets

(56) References Cited

U.S. PATENT DOCUMENTS

| | | | | |
|---|---|---|---|---|
| 8,831,508 | B2 | 9/2014 | Rasmussen et al. | |
| 8,942,396 | B2 | 1/2015 | Popovski et al. | |
| 2009/0154742 | A1* | 6/2009 | Rasmussen | H04R 25/43 381/312 |
| 2009/0296967 | A1* | 12/2009 | Mullenborn | H04R 25/554 381/315 |
| 2011/0033073 | A1* | 2/2011 | Inoshita | H04R 25/552 381/323 |
| 2011/0059696 | A1 | 3/2011 | Rasmussen et al. | |
| 2013/0005264 | A1* | 1/2013 | Sakata | H04W 52/0229 455/41.2 |
| 2013/0316642 | A1* | 11/2013 | Newham | H04W 52/0206 455/11.1 |

OTHER PUBLICATIONS

Torlak, Murat. "Path Loss—The University of Texas at Dallas." N.p., Oct. 21, 2012. Web. Nov. 29, 2016.*

* cited by examiner

HEARING ASSISTANCE SYSTEM AND METHOD

BACKGROUND OF THE INVENTION

Field of the Invention

The invention relates to a hearing assistance system comprising an first hearing assistance device to be worn at a first one of the user's ears for hearing stimulation of the first ear and a second hearing assistance device to be worn at the second ear of the user for hearing stimulation of the second ear, wherein both hearing assistance devices comprise a first interface for wireless data exchange with each other in order to implement binaural system and a second interface for wireless reception of an external data stream of external data stream source, such as a phone device or a wireless microphone.

Description of Related Art

Typically, the interface for binaural communication, which may use an inductive link, is a short range interface having a lower power consumption than the interface used for external data stream reception, which may use, for example, a 2.4 GHz technology, such as Bluetooth, in order to act as a long range interface.

Typically, power consumption is an issue for ear level devices. Therefore, binaural hearing assistant systems have been developed, wherein the external data stream is received only by one of the devices via the long range interface and is forwarded to the other device via the binaural short range interface.

U.S. Pat. No. 8,300,864 B2 relates to a binaural hearing aid system, wherein an audio stream from a telephone device is transmitted via a short range inductive link to one of the hearing aids and is forwarded via a second wireless link which is used by the hearing aids to exchange data to the other hearing aid.

U.S. Pat. No. 8,831,508 B2 relates to a binaural hearing aid system comprising two hearing instruments and a body-worn audio gateway device which form a body area network, wherein the audio gateway device acts as a master and the hearing instruments act as slaves, with the audio gateway device being connected via a wireless link to a phone device. The audio stream received by the master device is forwarded as an upstream signal to the slaves. In uplink may be used not only for audio data transmission but also for changing the settings of the slave devices by the master device.

U.S. Pat. No. 8,050,439 B2 relates to a binaural hearing system, wherein a bidirectional wireless link between the two hearing aids as used to exchange information concerning the battery charge status of each hearing aid in order to reduce power consumption of the hearing aid having the lower remaining battery lifetime once the difference of the remaining battery charges exceeds a certain limit.

U.S. Pat. No. 8,041,066 B2 relates to a binaural hearing aid system, wherein one of the two stereo channels received by one of the hearing aids via a wireless link is forwarded to the other hearing aid via a wireless link.

U.S. Pat. No. 8,526,648 B2 relates to a binaural hearing assistance system, wherein an audio signal from a wireless microphone is transmitted to the hearing assistances devices, wherein the link quality to each hearing assistance device is monitored, and wherein the signal received via the better link is relayed via a binaural link to the other hearing assistance device.

European Patent Application EP 2 439 960 A1 and corresponding U.S. Pat. No. 8,942,396 relate to a binaural hearing aid system, wherein data is relayed from one of the hearing aids to the other hearing aid if the other hearing aid does not receive the data correctly from a data streaming device which transmits data to both hearing aids.

SUMMARY OF THE INVENTION

It is an object of the invention to provide for a binaural hearing assistance system designed to receive an external data stream from an external data stream source, wherein the battery lifetime is maximized. It is a further object to provide for a corresponding hearing assistance method.

According to the invention, these objects are achieved by a hearing assistance system and a hearing assistance method as described herein.

The invention is beneficial in that, by monitoring the remaining battery lifetimes of both hearing assistance devices and by switching the master-slave role in case that the asymmetry in the remaining battery lifetimes (i.e., the battery charges) exceeds a given threshold, with the hearing assistance device having the longer remaining battery lifetime (i.e., the higher battery charge) forming the new master, the total use time of the system with one battery set can be optimized by preventing the case that the battery of one of the hearing devices is discharged quicker due to the higher power consumption of the device acting as the master, with the master forwarding the external data stream to the hearing assistance device acting as the slave.

Such role switching may occur in a "quasi-static" manner, for example, after start up of the hearing assistance devices, before entering a carrier detect mode of the hearing assistance devices or at the set up of the link to the external data source, or it may occur dynamically during reception and forwarding of the external data stream.

Hereinafter, examples of the invention will be explained with reference to the accompanying drawings.

DETAILED DESCRIPTION OF THE INVENTION

Figure 1:
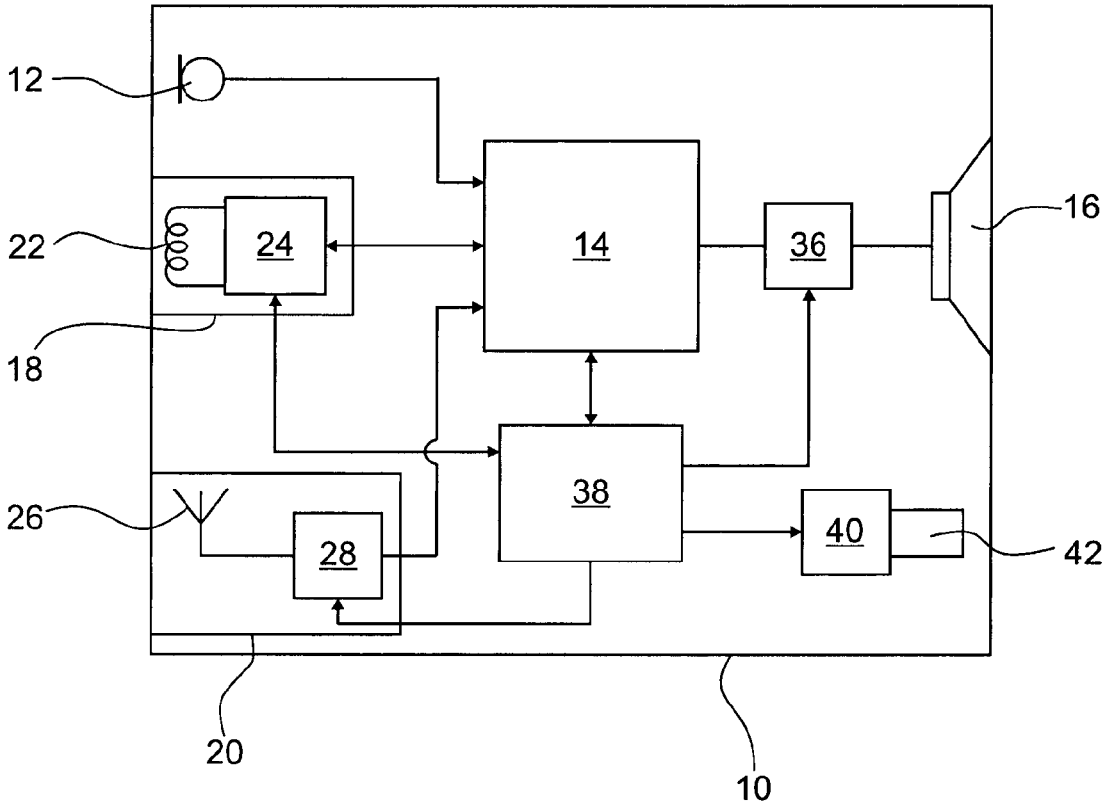
FIG. 1 is a block diagram of a hearing assistance device to be used in a hearing assistance system according to the invention system.
Figure 3:
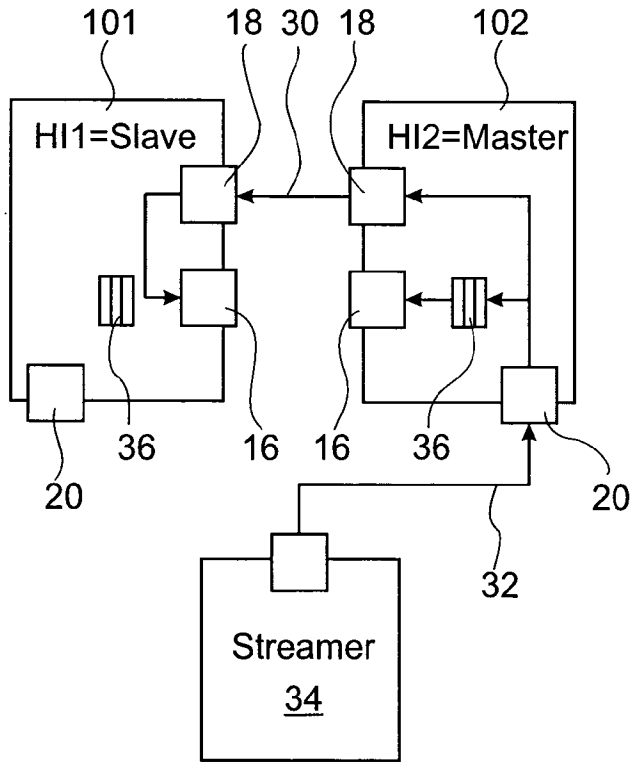
FIG. 3 is a block diagram like FIG. 2, wherein the system is shown after switching of the master-slave role.
Figure 2:
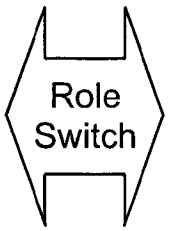
FIG. 2 is block diagram of an example of a hearing assistance system according to the invention in a first mode, wherein the right ear device acts as the master and the left ear device acts as the slave.
Figure 2:
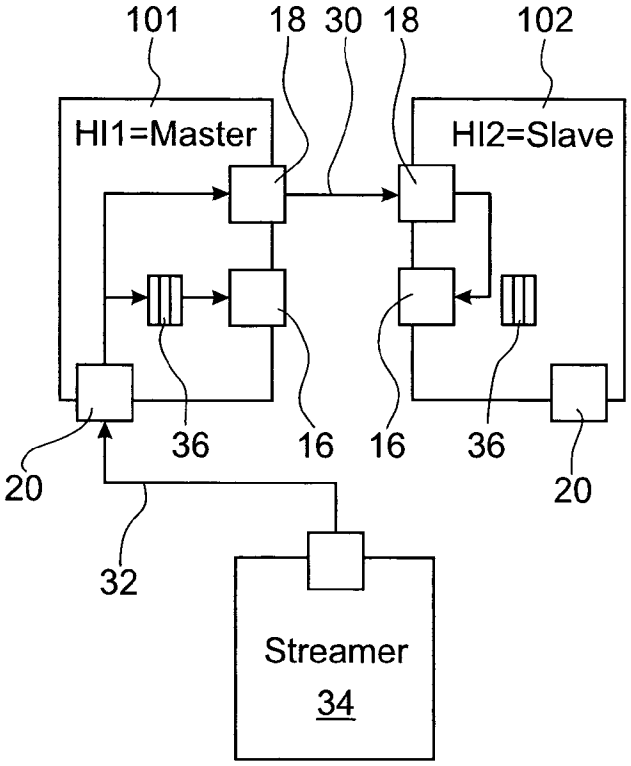

In FIG. 1, a hearing assistance device 10 is shown that forms part of a hearing assistance system according to the invention as shown in FIGS. 2 and 3. One such device 10 is to be worn at a first ear of a user and a second such device 10 is to be worn at the other ear of the user (the two devices are designated by 101 and 102 in FIGS. 2 and 3).

Preferably, the hearing assistance device 10 is a hearing instrument, such as a BTE (behind the ear), ITE (in the ear) or CIC (completely in the channel) hearing aid. According to the example of FIG. 1, the hearing assistance device 10 is an electro-acoustic hearing aid comprising a microphone arrangement 12 for capturing audio signals from ambient sound, an audio signal processing unit 14 for processing the captured audio signals and an electro-acoustic output transducer (loudspeaker) 16 for stimulation the user's hearing according to the processed audio signals.

The hearing instrument 10 also comprises a first wireless interface 18 and a second wireless interface 20. Typically, the first interface 18 is designed for a shorter range and a lower power consumption than the second interface 20; accordingly, hereinafter the first interface 18 also may be referred to as a "short range interface" (or HIBAN interface), and the second interface 20 may be referred to as a "long range interface". The first interface 18 comprises an antenna 22 and a transceiver 24, and the second interface comprises an antenna 26 and a transceiver 28.

The first interface 18 is provided for enabling wireless data exchange between the first hearing instrument 101 and the second hearing instrument 102 via a wireless link 30 which preferably is an inductive link which may operate, for example, in a frequency range of 6.765 MHz to 13.567 MHz, such as at 10.6 MHz. However, rather than being implemented as an inductive link, the wireless link 30 in principle also could be far-field link requiring a lower power consumption than the link of the second interface 20, such as a power optimized proprietary digitally modulated link operating in the 2.4 GHz ISM band.

In particular, the first interface 18 may be designed to form part of a hearing instrument body area network (HIBAN). In particular, the hearing instruments 101, 102 may exchange audio data and/or parameter settings/commands required for binaural operation of the two hearing instruments 101, 102, with one of the hearing instruments acting as the master and the other one acting as the slave according to a master-slave configuration.

The second interface 20 is provided for receiving an external data stream via a wireless link 32 from an external data stream source 34 (hereinafter referred to also as a "streamer"). Typically, the second interface 20 is adapted to operate in a frequency range of 0.38 GHz to 5.825 GHz, preferably at frequencies around 2.4 GHz in the ISM band. For example, the second interface 20 may be a Bluetooth interface, a WLAN (WiFi) interface or a GSM interface. It is to be noted that in principle the link 30 of the first interface 18 and the link 32 of the second interface 20 may have roughly the same range, in particular if they operate in the same frequency band, such as in the 2.4 GHZ ISM band, with the link 30 of the first interface 18 having a lower power consumption (e.g., due to a specific power reducing protocol). However, even if the link 30 of the first interface 18 and the link 32 of the second interface 20 operate in the same frequency band, they need not have the same range; for example, the link 30 of the first interface 18 may have a shorter range due to operation below its maximum transmit power.

Preferably, the external data stream is an audio data stream which may be mono stream or a stereo stream; alternatively or in addition the external data stream may include text data. The external data stream source 34 may be, for example, a phone device, such as a mobile phone or a DECT phone device, a music player, a HiFi set, a TV set or a wireless microphone.

The hearing instrument 10 also may comprise a delay unit 36 for applying a certain delay to the audio signal prior to being supplied to the output transducer 16 and a controller 38 for controlling operation of the hearing instrument 10, with the controller 38 acting on the signal processing unit 14, the transceivers 24, 28 and the delay unit 36.

The hearing instrument 10 also comprises a unit 40 for determining the charging status of the battery 42 of the hearing instrument 10, which provides a corresponding battery charge status signal to the controller 38.

In the example of FIG. 2, the hearing instrument 101 acts as a master and the hearing instrument 102 acts as a slave. In such configuration, the master hearing instrument 101 is configured to receive the external data stream via the link 32 and the long range interface 20 from the streamer 34, whereas the long range interface 20 of the slave hearing instrument 102 is deactivated in order to save power. The audio data received via the long range interface 20 is supplied to the signal processing unit 14 in order to generate a processed audio signal which is supplied to the speaker 16 via the delay unit 36. In addition, the audio data is received via the long range interface 20 is forwarded via the short range interface 18 and the short range link 30 to the slave hearing instrument 102, where it is received via the short range interface 22 and is supplied to the signal processing unit 14 in order to generate a processed audio signal which is supplied to the speaker 16 of the slave hearing instrument 102, without being delayed by the delay unit 36 (i.e., the delay unit 36 of the slave hearing instrument 102 is turned off)

The delay applied to the audio signal by the delay unit 36 of the master hearing instrument 101 is set such that the delay of the audio signal extracted in the slave hearing instrument 102 from the forwarded external data stream received via the short range interface 18 of the slave hearing instrument 102 relative to the audio signal extracted from the external data stream received via the long range interface 10 of the master hearing instrument 101 is compensated; i.e., the delay is set such that the audio signal extracted from the external data stream is supplied to the speaker 16 of the master hearing instrument 101 and to the speaker 16 of the slave hearing instrument 102 simultaneously.

In case of a mono audio stream the entire data stream is forwarded from the master hearing instrument 101 to the slave hearing instrument 102, so that the same audio signal is supplied to both ears of the user, whereas in case of a stereo audio stream only one channel is forwarded from the master hearing instrument 101 to the slave hearing instrument 102, while the other channel is used only by the master hearing instrument 101, so that one channel is reproduced by the master hearing instrument 101 and the other channel is reproduced by the slave hearing instrument 102.

In each of the hearing instruments 101, 102 the battery charge status is determined at some points in time, e.g., periodically, via the unit 40 in order to provide the controller 38 with periodically updated information concerning the battery charge status, such as every 15 minutes. In addition, the two hearing instruments 101, 102 at some points of time, e.g., periodically, such as every 15 minutes, battery charge status information is exchanged via the short range link 30, so that any variation in the battery charge of the two devices (battery charge asymmetry)—and hence in the remaining battery lifetimes—can be determined. Alternatively, the battery status information exchange (and the previous the check of the battery status) could be a periodic/heuristic: For example, during a passive mode of the hearing instruments (in which the power consumption is relatively low) regular data traffic via the short range interface 18, e.g., synchronization traffic or traffic of binaural algorithms, may be used to transport the battery status ("piggyback"), and only if there is no traffic for a certain time period, e.g., 1 hour, the battery status may be exchanged actively, but at a lower interval than in an active mode. According to a further alternative, in an active mode a static threshold might be used: for example, the exchange of battery status information starts only once the battery charge of the master drops below a certain threshold, such as 60%, or the interval of a periodic exchange of battery status information is shortened once the battery charge of the master drops below a certain threshold.

Once the difference in the charged battery levels is found to exceed a given threshold, it is decided by the system, i.e., by one of the hearing instruments 101, 102, that the master-slave roles have to be switched, with the hearing instrument having the higher battery charge (corresponding to the longer remaining lifetime) forming the new master after the role switching and the hearing instrument having the lower battery charge (corresponding to the shorter remaining battery lifetime) forming the new slave after role switching. The reason for such role switching resides in the fact that operation of the long range interface 20 consumes more power than operation of the short range interface 18, so that the hearing instrument acting as the master has a higher rate of power consumption than the hearing instrument acting as the slave. Thus, by such battery charge induced role switching, the total operation time of the system between two battery replacements can be extended.

The situation after a role switch is shown in FIG. 3, according to which the hearing instrument 102 now acts as the master and the hearing instrument 101 now acts as the slave, with the new master hearing instrument 102 activating its long range interface 20 for receiving the external data stream via the link 32 from the streamer 34, whereas the long range interface 20 of the new slave hearing instrument 101 is deactivated.

According to one embodiment, the master hearing instrument periodically transmits the information concerning the charging status of its battery 42 to the slave hearing instrument via the short range link 30, wherein the slave hearing instrument periodically compares its own battery charging status to the battery charging status information received from the master hearing instrument in order to decide whether role switching is already necessary and, if so, the controller 38 of the slave hearing instrument initiates role switching, for example, by transmitting a corresponding message to the master hearing instrument via the short range link 30. According to this embodiment, the slave hearing instrument does not have to send its own battery charging status information to the master hearing instrument.

According to an alternative embodiment, battery charge information is exchanged bidirectionally, rather than unidirectionally, so that both the master hearing instrument and the slave hearing instrument periodically transmit the respective battery charging status information to the other hearing instrument; in this case, both hearing instruments are able to determine the asymmetry of the remaining battery lifetimes, and each of the hearing instruments may initiate the role switching.

It is noted that the master-slave configuration of the hearing instruments 10 does not necessarily relate to the low-power/short range wireless link 30 in general. Only the forwarded traffic concerning the external data stream from the streamer 34 is necessarily handled in a master-slave configuration/manner, other traffic via the short range link 30 may also be handled in a distributed, unsupervised way.

Several alternative examples concerning the manner how master-slave role switching may be carried out are described below.

One option is to carry out role switching after start-up of the hearing instruments 10. Such role switch after start-up implies that the state is persistent, i.e., the role of a device is stored in non-volatile memory (flash memory) and restored at start-up/reboot. Alternatively, the role/state may be non-persistent, i.e., only stored in volatile memory (RAM), in this case it would rather be a role assignment after start-up than a role switch.

Another option is to carry out role switching before the long range interface 20 of the master hearing instrument enters a carrier detect mode. A still further option is to carry out role switching at set up of the long range interface 20 of the master hearing instrument before streaming of the external data stream starts.

As a further alternative to such "quasi-static" role switching, role switching may be carried out dynamically during reception and forwarding of the external data stream by the master hearing instrument. In this case, the role switch is initiated by the slave hearing instrument or, alternatively, the slave hearing instrument is notified by the master hearing instrument, via the short range link 30, to initiate a role switch, and then the slave hearing instrument activates its long range interface 20 in order to receive the external data stream via the long range link 32 from the streamer 34, whereupon the external data stream received via the long range interface 20 of the slave hearing instrument is forwarded by the slave hearing instrument via its short range interface 18 to the master hearing instrument. The master hearing instrument then confirms reception of the forwarded external data stream by sending a corresponding message to the slave hearing instrument, whereupon a role switching transition phase is started, during which the master hearing instrument fades the audio input from its long range interface 20 to its short range interface 18 and the slave hearing instrument fades its audio input from its short range interface 18 to its long range interface 20, with these two fading actions being synchronized between the master hearing instrument and the slave hearing instrument. After termination of the fading actions, the master hearing instrument deactivates its long range interface 20 and becomes the new slave hearing instrument, while the former slave hearing instrument becomes the new master hearing instrument.

In case that the external data stream contains a stereo signal, the slave hearing instrument, when the role switch has been initiated, may forward only one of the two stereo channels to the master hearing instrument.

During the fading actions in both hearing instruments 10, a respective delay has to be applied by the delay unit 36 of each hearing instrument in order to compensate for the delay between the audio stream received via the long range interface 20 and the forwarded external audio stream received via the short range interface 18.

Generally, the external data stream provided by the streamer 30 may be transmitted as a broadcast stream, as a multicast stream or as a cast stream. While all of these three options apply to quasi-static role switching, dynamic role switching requires a multicast stream.

In case of a mono audio stream, the power saving potential may be higher, since reception of a stereo stream by the master hearing instrument may cost more power than reception of a mono stream.

While the examples discussed so far primarily relate to an active streaming state of the system, in which an external data stream is provided by the streamer 34, the master-slave role switching concept is beneficial also in a passive state of the system during which no streaming is active, i.e., with the streamer 34 being inactive or with no streamer being present at all within the range of the long range interfaces 20. In such passive state the master hearing instrument operates its long range interface 20 in a carrier detect mode in order to detect reception of an external data stream, while the long range interface 20 of the slave hearing instrument is deactivated.

Also in the passive state the respective battery charge status is monitored periodically in order to switch the master-slave role once the asymmetry in the battery charge is found to exceed the threshold value.

In other embodiments, additional short range (e.g., HIBAN) nodes could be included: For example, a remote control device having a larger battery could handle the passive mode (wherein there is no streaming) and assign the master role to one of the hearing instruments after carrier detection.

What is claimed is:

1. A hearing assistance system, comprising:

a first hearing assistance device configured to be worn at a first ear;

a second hearing assistance device configured to be worn at a second ear, wherein the first and second hearing assistance devices include a first interface for wireless data exchange between the first hearing assistance device and the second hearing assistance device and a second interface for wireless reception of an external data stream from an external data stream source, wherein the external data stream source is configured to transmit the external data stream as a multicast stream, wherein the first and second hearing assistance devices are configured to periodically exchange battery charge status information between the hearing assistance devices to monitor battery lifetimes, wherein the first and second hearing assistance devices are configured to switch between behaving as a master device and behaving as a slave device when a difference in battery charge between the first and second hearing devices exceeds a threshold, wherein the master device receives the external data stream via the second interface and forwards the external data stream to the slave device via the first interface, and wherein the interval of the periodic exchange of battery charging status information is shortened during times when no external data stream is received by the hearing assistance devices.

2. The system of claim 1, wherein the first interface has a lower power consumption than the second interface.

3. The system of claim 1, wherein the first interface is configured to exchange battery charge information between the first and second hearing assistance devices.

4. The system of claim 1, wherein the first and second hearing assistance devices are configured to act as the master during times when no external data stream is received, and during these times the second interface is deactivated.

5. The system of claim 1, wherein the external data stream is an audio data stream.

6. The system of claim 5, wherein the external data stream source is at least one of the following: a smart phone, a music player, a wireless microphone, a TV set, or a HiFi set.

7. The system of claim 6, wherein the audio data stream is stereo stream or a mono stream.

8. The system of claim 1, wherein the first and second hearing assistance devices include a delay unit to compensate for a delay of an audio signal extracted from a forwarded external data stream received via the first interface relative to an audio signal extracted from the external data stream received via the second interface, and wherein the first and second hearing assistance devices are configured to have the delay unit act on the audio signal extracted from the external received via the second interface when acting as the master.

9. The system of claim 1, wherein the second interface is configured to operate in a frequency range of 0.38 GHz to 5.825 GHz.

10. The system of claim 1, wherein the second interface is configured to operate at a frequency of 2.4 GHz in the Industrial, Scientific, and Medical (ISM) band.

11. The system of claim 1, wherein the second interface is at least one of the following: Bluetooth, GSM and WLAN interface.

12. The system of claim 1, wherein the first interface is configured to use an inductive link.

13. The system of claim 1, wherein the first interface is adapted to operate in a frequency range of 6.765 MHz to 13.567 MHz.

14. The system of claim 12, wherein the first interface is adapted to form part of a hearing instrument body area network.

15. The system of claim 1, wherein the external data stream source is adapted to transmit the external data stream an any cast stream, a broadcast stream, and a multicast stream.

16. The system of claim 1, wherein first and second hearing assistance devices are adapted to initiate a role switch of master and slave after start-up of the device.

17. The system of claim 1, wherein the first and second hearing assistance devices are adapted to initiate a role switch of master and slave before entering a carrier detect mode of the second interface.

18. The system of claim 1, wherein first and second hearing assistance devices are adapted to initiate a role switch of master and slave at set-up of the second interface for wireless reception of the external data stream before streaming of the external data stream starts.

19. The system of claim 1, wherein the first and second hearing assistance are adapted to determine whether asymmetry in the battery charges exceeds a threshold.

20. The system of claim 1, wherein the first and second hearing assistance devices are hearing instruments.

21. The system of claim 20, wherein the first and second hearing assistance devices are electro-acoustic hearing aids.

22. The system of claim 1, wherein during times when no external data stream is receive by the hearing assistance devices, synchronization data traffic or binaural data exchange traffic via the first interface is used to repeatedly exchange information concerning the charging status of the battery of the respective hearing assistance device with the other hearing assistance device.

23. A hearing assistance system, the system comprising:

a first hearing device configured to be worn at a first ear; and a second hearing device configured to be worn at a second ear, wherein the first and second hearing devices include a first interface for wireless communication between the hearing devices and a second interface for wireless reception of an external data stream from an external data stream source, wherein the first and second hearing devices are configured to periodically exchange battery charge status information between the hearing devices, wherein an interval of the periodic exchange of battery charging status information is shortened during times when no external data stream is received by the hearing devices, wherein the first and second hearing devices are configured to switch between a master device and a slave device when a difference in battery charge status between the hearing devices exceeds a threshold, and wherein the master device receives the external data stream via the second interface and forwards the external data stream to the slave device via the first interface.

24. The system of claim 23, wherein the first and second hearing devices include a delay unit configured to provide a synchronized output of the external data stream to a user wearing the first and second hearing devices.

25. The system of claim 23, wherein the first interface is adapted to operate at a frequency of 2.4 GHz in the Industrial, Scientific, and Medical (ISM) band using a protocol requiring less power consumption than that used by the second interface when receiving the external data stream.

26. The system of claim 23, wherein the first interface has a shorter range than the second interface.

27. A method for operating hearing devices, the method comprising:

receiving, via a first hearing device, an audio stream from a mobile device;

providing, via the first hearing device, the audio stream to a user;

forwarding, via the first hearing device, a portion of the audio stream to a second hearing device, providing, via the second hearing device, the forwarded portion of the audio stream to the user;

delaying the provided audio stream in the first or second hearing device to cause the first and second hearing devices to provide the audio stream simultaneously to the user;

determining that the first hearing device has less available power than the second hearing device; and in response to determining the first hearing device has less available power, switching the first hearing device from a master to a slave and switching the second hearing device from a slave to a master, wherein the first and second hearing devices are adapted to periodically exchange information concerning charging status of a battery of the respective hearing devices to monitor the remaining battery lifetimes, and wherein an interval of the periodic exchange of battery charging status information is shortened during times when no audio stream is received by the hearing devices.

28. The method of claim 27, wherein the hearing devices are hearing aids.

29. The method of claim 27, wherein the first and second hearing devices include a delay unit configured to provide a synchronized output of the audio stream to a user wearing the first and second hearing devices.

* * * * *